US006450146B1

(12) United States Patent
Dickerson et al.

(10) Patent No.: US 6,450,146 B1
(45) Date of Patent: Sep. 17, 2002

(54) HIGH PRESSURE PUMP WITH A CLOSE-MOUNTED VALVE FOR A HYDRAULIC FUEL SYSTEM

(75) Inventors: Steven J. Dickerson, Lake in the Hills; John J. Bryjak, Park Ridge; Michael A. Majewski, Joliet, all of IL (US)

(73) Assignee: International Engine Intellectual Property Company, L.L.C., Warrenville, IL (US)

( * ) Notice: Subject to any disclaimer, the term of this patent is extended or adjusted under 35 U.S.C. 154(b) by 0 days.

(21) Appl. No.: 09/735,597

(22) Filed: Dec. 12, 2000

(51) Int. Cl.[7] ..... F02M 47/04; F04B 27/08
(52) U.S. Cl. ..... 123/446; 417/269; 417/441
(58) Field of Search ..... 123/446, 447, 123/506; 417/269, 437, 440, 441

(56) References Cited

U.S. PATENT DOCUMENTS

| | | | | |
|---|---|---|---|---|
| 4,145,166 A | | 3/1979 | Justice | |
| 4,239,463 A | | 12/1980 | Yaindl | |
| 4,291,588 A | | 9/1981 | Justice | |
| 4,669,500 A | | 6/1987 | Strelow | |
| 5,191,867 A | | 3/1993 | Glassey | |
| 5,228,844 A | * | 7/1993 | Klopfer et al. | 417/440 |
| 5,230,610 A | * | 7/1993 | Reichenmiller | 417/269 |
| 5,236,319 A | | 8/1993 | Fischer et al. | |
| 5,720,168 A | | 2/1998 | Harnischfeger | |
| 5,807,090 A | | 9/1998 | Agner | |
| 5,839,413 A | | 11/1998 | Krause et al. | |
| 5,975,233 A | | 11/1999 | Eisenbacher | |
| 6,035,828 A | * | 3/2000 | Anderson et al. | 123/446 |
| 6,216,670 B1 | * | 4/2001 | Anderson et al. | 123/446 |

* cited by examiner

*Primary Examiner*—Tony M. Argenbright
(74) *Attorney, Agent, or Firm*—Dennis Kelly Sullivan; Jeffrey P. Calfa; Neil T. Powell

(57) ABSTRACT

This invention provides a pump with a close-mounted valve for a hydraulic fuel system in an internal combustion engine. The hydraulic fuel system may have a high pressure pump connected to a low pressure side and high pressure reservoirs. The pump has a drive shaft, a shaft cylinder, one or more cylinders, and a close-mounted valve. The close-mounted valve has a valve body, a valve spool, a valve spring, and a valve coil. The valve body is positioned inside a shaft cavity formed by the shaft cylinder. The close-mounted valve may control the volume and pressure to reduce or eliminate the dumping of high-pressure hydraulic fluid in the hydraulic fuel system.

17 Claims, 5 Drawing Sheets

HIGH PRESSURE PUMP WITH A CLOSE-MOUNTED VALVE FOR A HYDRAULIC FUEL SYSTEM

FIELD OF THE INVENTION

This invention relates generally to pumps for hydraulic systems. More particularly, this invention relates to pumps with throttle valves for hydraulic fuel systems in internal combustion engines.

BACKGROUND OF THE INVENTION

Many internal combustion engines use hydraulically-activated electronically-controlled unit injection (HEUI) fuel systems to improve engine performance. HEUI fuel systems require high pressure hydraulic fluid to operate fuel injectors. FIG. 4 shows a hydraulic system according to the prior art. The hydraulic system is for an engine with a V-configuration and has a high pressure side incorporated with a low pressure side. The high pressure side operates the fuel injectors. A high pressure pump provides hydraulic fluid from a low pressure reservoir through an injection pressure regulation (IPR) valve to high pressure reservoirs. The low pressure side provides lubrication for various components of the engine including a cylinder head, cylinders, pistons, a turbocharger, and the like. A low pressure pump provides hydraulic fluid from a sump to the low pressure reservoir and to the engine. The hydraulic fluid passes through an engine cooler and an oil filter. The high and low pressure sides have other components such as check and bypass valves, which are not shown.

During engine operation, the IPR valve and high pressure pump control the volume and pressure of the hydraulic fluid. The IPR valve controls the pressure of the hydraulic fluid to be in a range of about 500 psi through about 6,000 psi. The IPR valve typically reciprocates between open and closed positions to maintain or regulate pressure. An open position dumps high-pressure hydraulic fluid from the high pressure pump. A closed position does not dump hydraulic fluid. When higher pressure is required, the IPR valve closes or reciprocates more in a closed position. When lower pressure is required, the IPR opens or reciprocates more in an open position to dump hydraulic fluid.

In addition, the high pressure pump adjusts the volume of hydraulic fluid depending upon the operating requirements of the engine. FIG. 5 shows a side view of a high pressure pump according to the prior art. A support shaft, bearing shaft, and drive shaft are radially aligned and disposed inside a pump housing. A bearing spring biases a slipper plate against a spherical bearing mounted on the bearing support. Several cylinders are disposed radially around the support shaft. A piston is disposed within each cylinder. Each piston is pivotally connected to the slipper plate. The drive shaft has a swash plate, which engages the slipper plate. The swash plate sits at an angle to the cylinders.

As the drive shaft rotates, the swash plate pushes pistons into the cylinders on one side and pulls or lets the pistons out of the cylinders on the other side. A complete rotation of the drive shaft causes each piston to reciprocate one stroke in the cylinder. Hydraulic fluid from the low pressure reservoir enters a low pressure inlet along the outside of the pump housing. A valve controls the amount of hydraulic fluid exiting a valve outlet into an oil feed chamber, which surrounds the cylinders. The oil feed chamber has a cylinder inlet into each cylinder. As the piston reciprocates toward the swash plash, the piston passes the cylinder inlet. The cylinder inlet opens and hydraulic fluid fills the cylinder. As the piston reciprocates away from the swash plate, the cylinder inlet closes and the piston pushes the hydraulic fluid against a vent plate in the cylinder. The vent plate eventually opens permitting high pressure hydraulic fluid to enter a discharge chamber. The hydraulic fluid accumulates in the discharge chamber until it exits the high pressure pump through a high pressure outlet. A retention plate prevents the backflow of hydraulic fluid into the cylinder from the discharge chamber.

Generally, the high pressure pump provides more hydraulic fluid when higher pressure is required and provides less hydraulic fluid when lower pressure is required. The valve typically closes when there is a need for less hydraulic fluid. However, there may be a lag period between the time the lower volume is needed and the time the valve closes. Hydraulic fluid in the oil feed chamber generally passes through the pump, is pressurized, and is dumped. The oil feed chamber may hold up to 0.75 liters of hydraulic fluid.

The dumping of high-pressure hydraulic fluid reduces engine efficiency and increases operating costs. While a single "dumping" of hydraulic fluid may be less significant, the accumulated dumping of hydraulic fluid may reduce engine efficiency in a range of about 5 percent through about 15 percent. The reduced efficiency increases fuel consumption and may increase the maintenance of the engine.

SUMMARY

This invention provides a pump with a close-mounted valve for a hydraulic fuel system in an internal combustion engine. The close-mounted valve may be used to control the hydraulic fluid volume and the hydraulic fluid pressure. The close mounted value also may be used with or without an injection pressure regulation (IPR) valve. The close-mounted value may reduce or eliminate the need to dump high-pressure hydraulic fluid in a hydraulic fuel system.

In one aspect, a hydraulic fuel system for an internal combustion engine has a high pressure pump connected to a low pressure side and one or more high pressure reservoirs. The high pressure pump has a drive shaft, a shaft cylinder, one or more cylinders, and a close-mounted valve. The shaft cylinder is aligned with the drive shaft and forms a shaft cavity. One or more cylinders are positioned next to the shaft cylinder. The cylinders have one or more cylinder inlets into the shaft cavity. The close-mounted valve has a valve body, a valve spool, a valve spring, and a valve coil. The valve body is positioned inside the shaft cavity. The valve body forms a valve cavity having one or more valve outlets corresponding to the one or more cylinder inlets. The valve spool has an armature and is positioned inside the valve cavity. The valve spring is positioned between the armature and the valve body to bias the valve spool. The valve coil positioned along the valve body and around the armature.

In another aspect, a pump for a hydraulic fuel system in an internal combustion engine has a drive shaft, a shaft cylinder, one or more cylinders, and a close-mounted valve. The shaft cylinder is aligned with the drive shaft and forms a shaft cavity. The one or more cylinders is disposed adjacent to the shaft cylinder. The cylinders form one or more cylinder inlets into the shaft cavity. The close-mounted valve is positioned in the shaft cavity and has a valve body, a valve spool, a valve spring, and a valve coil. The valve body forms a valve cavity having one or more valve outlets corresponding to the one or more cylinder inlets. The valve spool has an armature and is positioned in the valve cavity. The valve spring is positioned between the armature and the valve body to bias the valve spool. The valve coil is positioned along the valve body and around the armature.

Other systems, methods, features, and advantages of the invention will be or will become apparent to one skilled in the art upon examination of the following figures and detailed description. All such additional systems, methods, features, and advantages are intended to be included within this description, within the scope of the invention, and protected by the accompanying claims.

BRIEF DESCRIPTION OF THE FIGURES

The invention may be better understood with reference to the following figures and detailed description. The components in the figures are not necessarily to scale, emphasis being placed upon illustrating the principles of the invention. Moreover, like reference numerals in the figures designate corresponding parts throughout the different views.

DETAILED DESCRIPTION OF THE PREFERRED EMBODIMENTS

Figure 1:
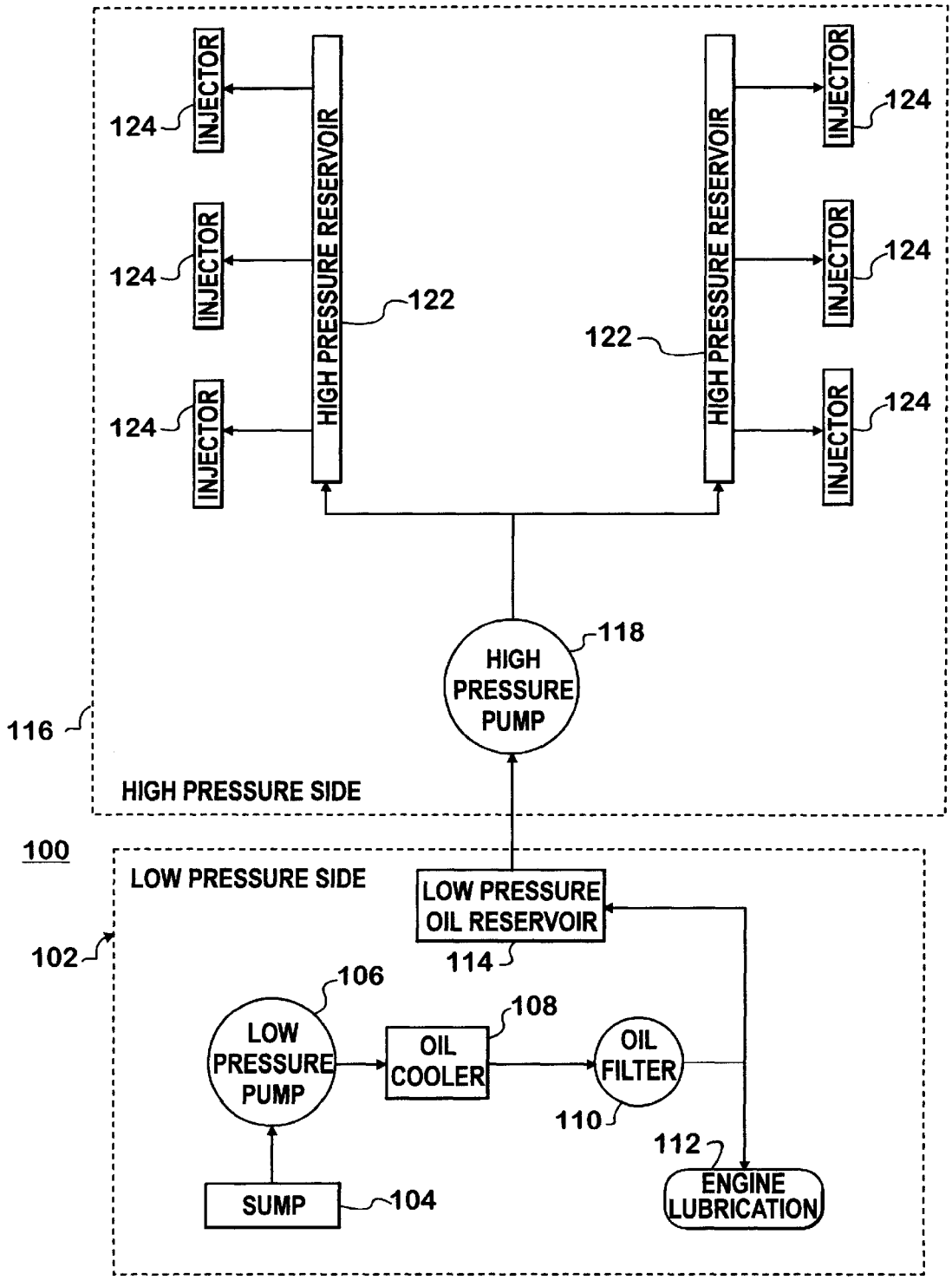
FIG. 1 represents a block diagram of a hydraulic system with a high pressure pump having a close-mounted valve according to one embodiment.

FIG. 1 represents a block diagram of a hydraulic fuel system 100 with a high pressure pump 118 having a close-mounted valve according to one embodiment. The hydraulic fuel system 100 has a low pressure side 102 and a high pressure side 116. The low pressure side 102 includes a sump 104, a low pressure pump 106, oil cooler 108, an oil filter 110, and a low pressure reservoir 114. The low pressure pump 106 pumps hydraulic fluid from the sump 104 through the oil cooler 108 and the oil filter 110. The hydraulic fluid provides engine lubrication 112, which may include a turbocharger, cylinders, a cylinder head, and other areas of the engine. In addition, oil is pumped to the low pressure oil reservoir 114 for use by the high pressure side 116. The high pressure side 116 includes a high pressure pump 118, which provides oil to two high pressure reservoirs 122. In one aspect, the hydraulic system 100 is for a V-configured 6 cylinder diesel engine. There are two high pressure reservoirs 122 disposed in each of the V sections. Each reservoir serves three fuel injectors 124.

Figure 2:
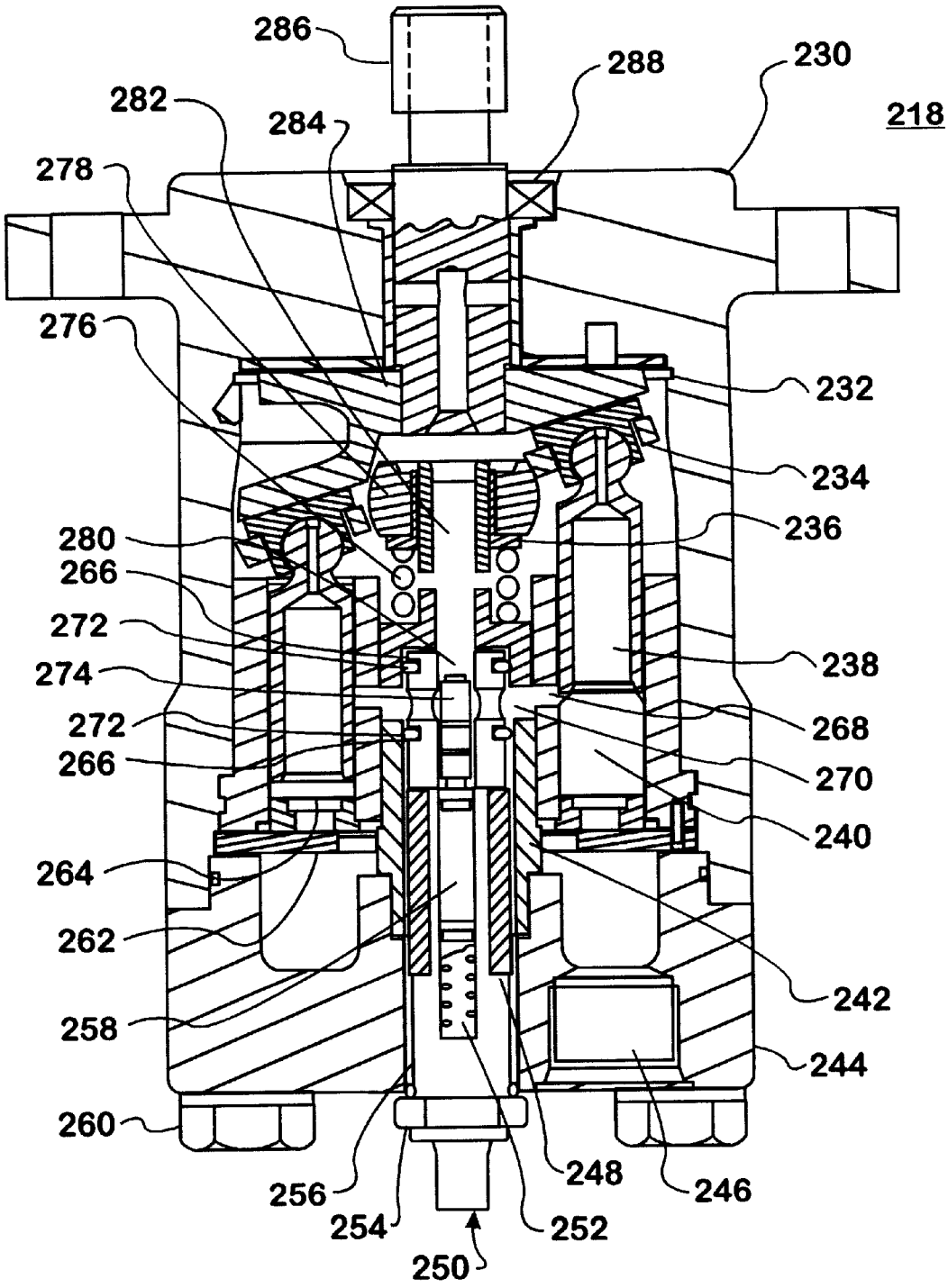
FIG. 2 represents a side view of a high pressure pump with a close-mounted valve according to one embodiment.

FIG. 2 represents a side view of a high pressure pump 218 with a close-mounted valve 250 according to one embodiment. A shaft cylinder 242 and drive shaft 286 are radially aligned and disposed inside a pump housing 230. Bearing spring 276 biases a slipper plate 234 against a spherical bearing 278 mounted on the shaft cylinder 242. A bushing 236 is positioned between the shaft cylinder 242 and the bearing spring 276. One or more cylinders 240 are disposed radially around the shaft cylinder 242. A piston 238 is slidably disposed within each cylinder 240. Each piston 238 is pivotally connected to the slipper plate 234. The drive shaft 286 has a swash plate 284, which engages the slipper plate 234. A retaining ring 232 is operatively disposed between the swash plate 284 and the pump housing 230. The swash plate 284 sits at an angle to the cylinders 240. As the drive shaft 286 rotates, the swash plate 284 pushes pistons 238 into the cylinders 240 on one side and pulls or lets the pistons 238 out of the cylinders 240 on the other side. A rotation of the drive shaft 286 causes each piston 238 to reciprocate one stroke in the cylinder 240.

The shaft cylinder 242 forms a cavity for radially receiving the close-mounted valve 250. The shaft cylinder 242 also forms valve outlets 270 that correspond to cylinder inlets 268 into each cylinder 240. In one aspect, the close-mounted valve 250 has a valve body 256 forming a valve cavity with openings corresponding to the valve outlets 270. The valve body 256 has valve o-rings 272 disposed in grooves 266 adjacent to the valve outlets 270. The valve cavity has a valve inlet 280 opening into a valve inlet chamber 282 formed by the shaft cylinder 242. A valve spool 274 with an armature 258 is slidably disposed in the valve cavity. A valve spring 252 is disposed between the armature 258 and the valve body 254 to bias the valve spool 274 toward the swash plate 284. A valve coil 248 is positioned along the valve body 254 and around the armature 258. When the valve spool 274 is fully biased, the valve spool 274 essentially closes the valve outlets 270. When a current is applied to the valve coil 248, the armature 258 and the valve spool 274 slide away from the swash plate 284 thus opening the valve outlets 270. By changing the current, the armature 258 and the valve spool 274 may reciprocate inside the valve cavity thus opening and closing the valve outlets 270. A microprocessor or other control device (not shown) may be attached to the valve coil 248 for controlling the current applied to the valve coil 248.

When the high pressure pump 218 is operating, hydraulic fluid from the low pressure reservoir enters a valve inlet chamber 282. A current is applied to the valve coil 248, so the armature 258 and the valve spool 274 slide away from the swash plate 284 and open the valve outlets 270. Hydraulic fluid is then available at the cylinder inlets 268. The current may be applied to the valve coil 248 so the armature 258 and valve spool 274 reciprocate inside the valve cavity. This reciprocating motion may be used to control the volume and pressure of the hydraulic fluid in a hydraulic fuel system such that an IPR valve may not be needed. The close-mounted valve 250 may reduce or essentially eliminate the dumping of high pressure hydraulic fluid.

As each piston 238 reciprocates toward the swash plate 284, the piston 238 passes the cylinder inlet 268. The cylinder inlet 269 opens causing hydraulic fluid to fill the cylinder 240. As each piston 238 reciprocates away from the swash plate 284, the cylinder inlet 268 closes and the piston 238 pushes the hydraulic fluid against a vent plate 264 in the cylinder 240. The vent plate 264 eventually opens permitting high pressure hydraulic fluid to enter a discharge chamber 244, which is connected to the pump housing 230 by bolts 260. The hydraulic fluid accumulates in the discharge chamber 244 until it exits the high pressure pump 218 through a high pressure outlet 246. A retention plate 262 prevents the backflow of hydraulic fluid into the cylinder 240 from the discharge chamber 244.

Figure 3:
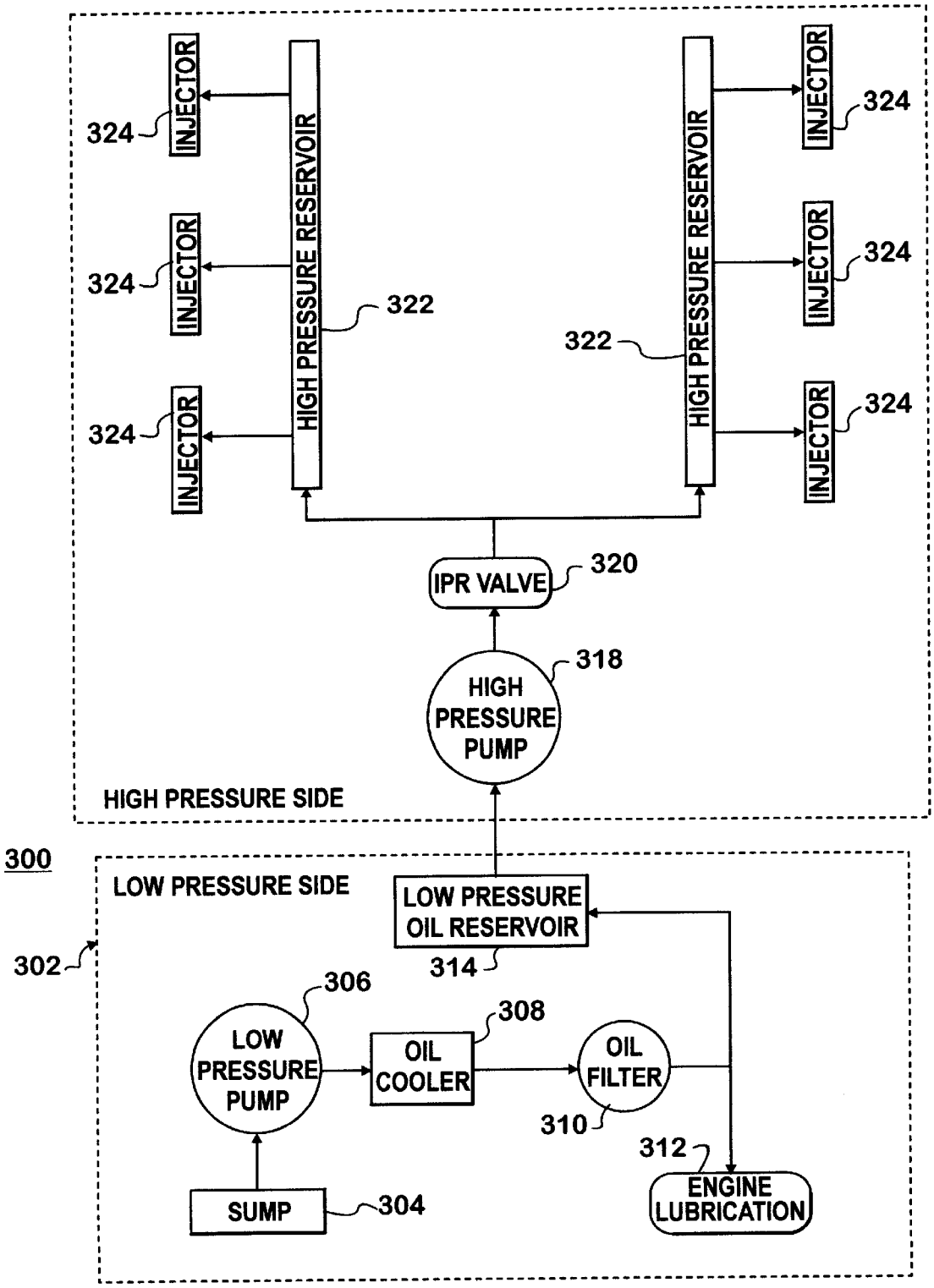
FIG. 3 represents a block diagram of a hydraulic fuel system with a high pressure pump having a close-mounted valve according to another embodiment.
Figure 4:
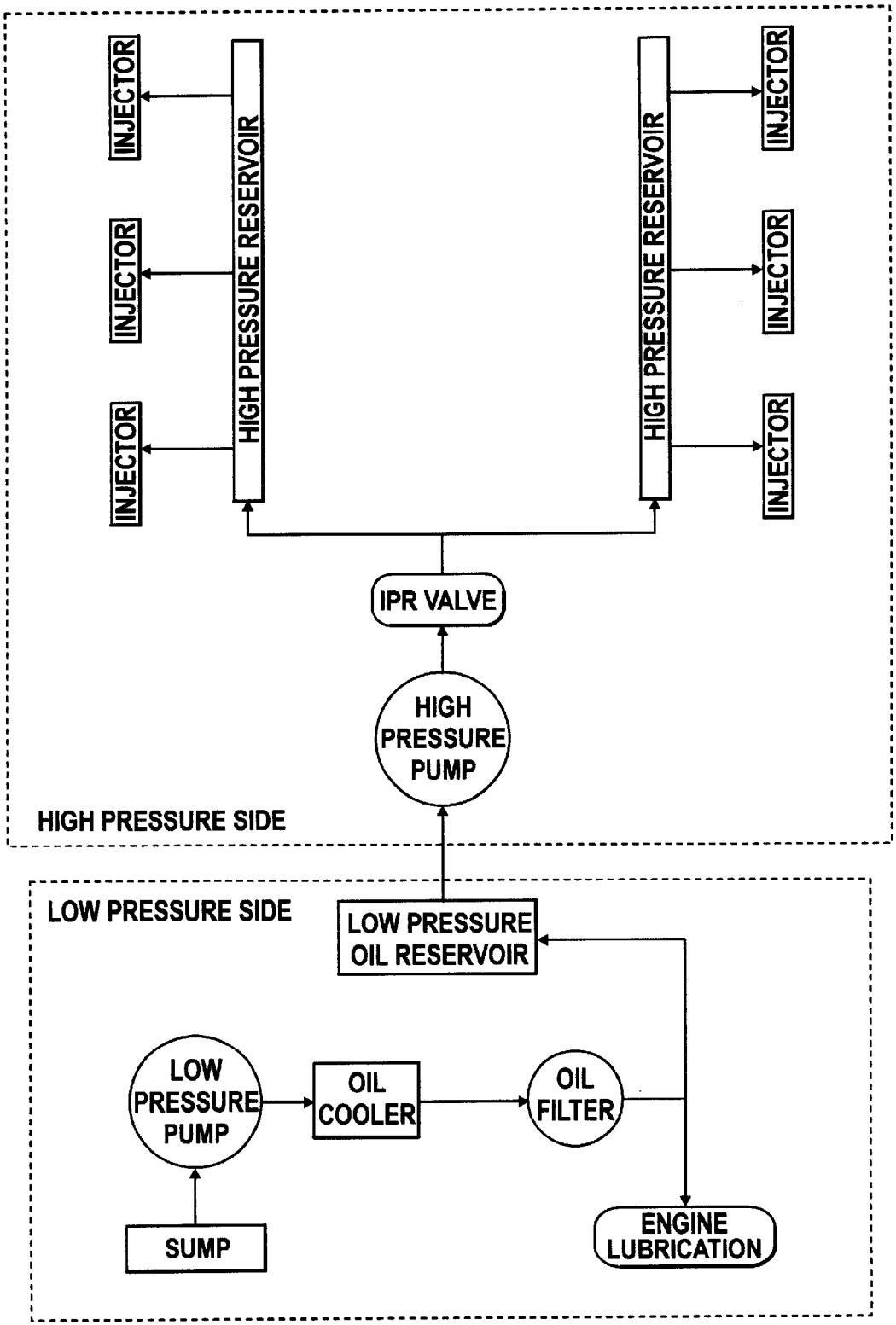
FIG. 4 PRIOR ART
FIG. 4 is a block diagram of a hydraulic fuel system according to the prior art.
Figure 5:
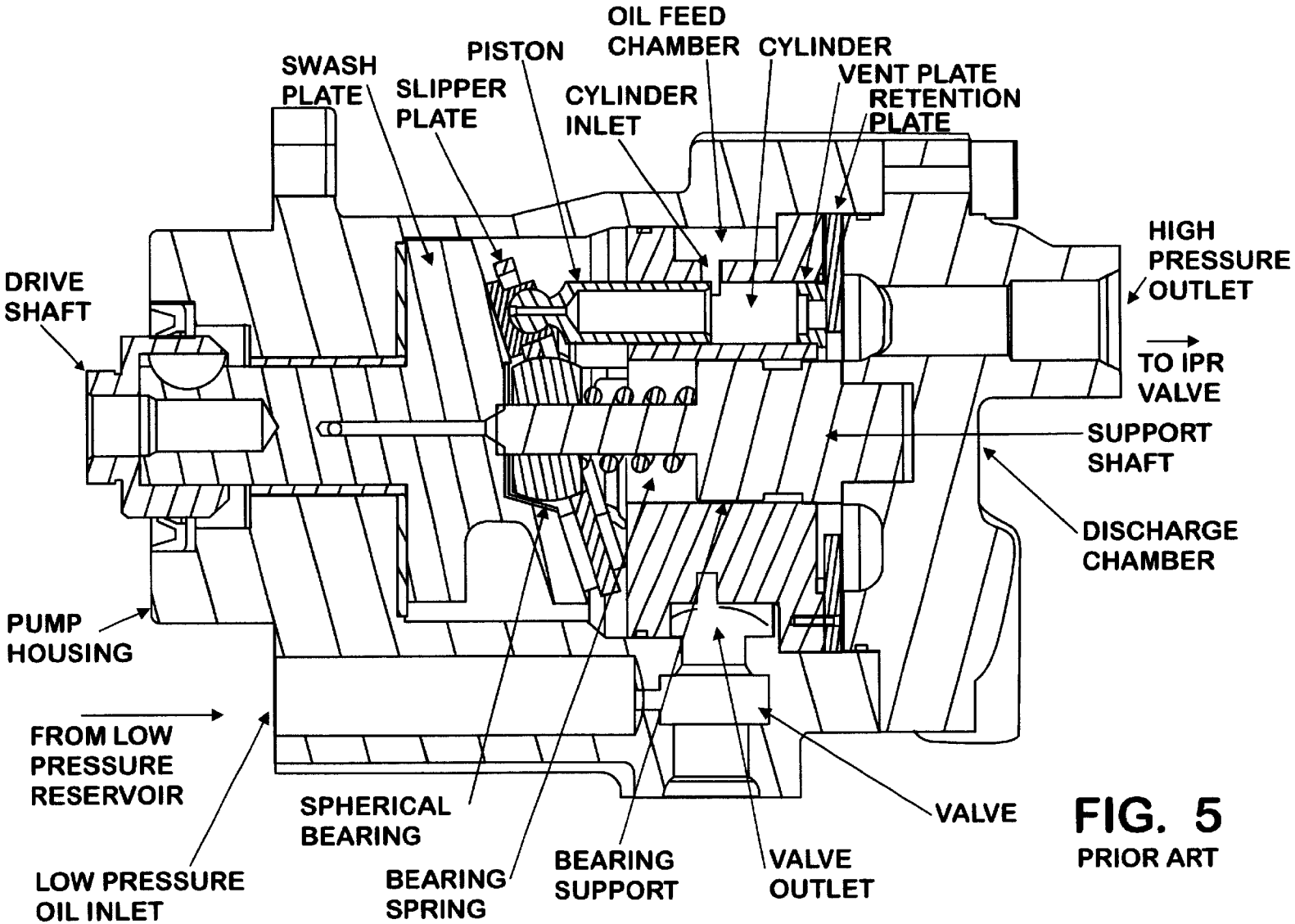
FIG. 5 PRIOR ART
FIG. 5 is a side view of a high pressure pump according to the prior art.

FIG. 3 represents a block diagram of a hydraulic fuel system 300 having a high pressure pump 318 with a close-mounted valve according to another embodiment. The hydraulic fuel system 300 is essentially the same as the hydraulic fuel system 100 except for the addition of an IPR valve 320. The hydraulic fuel system 300 has a low pressure side 302 and a high pressure side 316. The low pressure side 302 includes a sump 304, a low pressure pump 306, oil cooler 308, an oil filter 310, and a low pressure reservoir 314. The low pressure pump 306 pumps hydraulic fluid from the sump 304 through the oil cooler 308 and the oil filter 310. The hydraulic fluid provides engine lubrication 312, which may include a turbocharger, cylinders, a cylinder head, and other areas of the engine. In addition, oil is pumped to the low pressure oil reservoir 314 for use by the high pressure side 116. The high pressure side 316 includes the high pressure pump 318, which provides oil through the IPR valve 320 to high pressure reservoirs 322. In one aspect, the hydraulic system 300 is for a V-configured six cylinder diesel engine. There are two high pressure reservoirs 322 disposed in each of the V sections. Each reservoir serves three fuel injectors 324. In this embodiment, the close-mounted valve controls at least the volume of the hydraulic fluid out of the high pressure pump. The close-mounted valve also may partially or completely control the pressure of the hydraulic fluid. The IPR valve 320 may control the pressure or operate in conjunction with close-mounted valve to control the pressure. In one aspect, the IPR valve 320 provides trim control to adjust the pressure provided by the high pressure pump 318.

While configurations and components have been described for the hydraulic systems 100 and 300 and the high pressure pump 218, other configurations including those with fewer or additional components may be used. The hydraulic system may have check and bypass valves and may be configured for use on an in-line or other internal combustion engine. The high pressure pump may be configured to provide lower pressure hydraulic fluid or may be a low pressure hydraulic pump. The close-mounted valve 250 may another spool valve or valve device for controlling the volume or pressure of hydraulic fluid in a pump.

Various embodiments of the invention have been described and illustrated. However, the description and illustrations are by way of example only. Many more embodiments and implementations are possible within the scope of this invention and will be apparent to those of ordinary skill in the art. Therefore, the invention is not limited to the specific details, representative embodiments, and illustrated examples in this description. Accordingly, the invention is not to be restricted except in light as necessitated by the accompanying claims and their equivalents.

What is claimed is:

1. A hydraulic fuel system for an internal combustion engine, comprising:

a low pressure side;

at least one high pressure reservoir; and a high pressure pump connected to the low pressure side and to the at least one high pressure reservoir, the high pressure pump comprising a drive shaft;

a shaft cylinder radially aligned with the drive shaft, the shaft cylinder forming a shaft cavity;

at least one cylinder disposed adjacent to the shaft cylinder, where the at least one cylinder forms at least one cylinder inlet into the shaft cavity; and a close-mounted valve comprising, a valve body forming a valve cavity, the valve body disposed in the shaft cavity, the valve cavity having at least one valve outlet corresponding to the at least one cylinder inlet, a valve spool with an armature slidably disposed in the valve cavity, a valve spring disposed between the armature and the valve body to bias the valve spool, and a valve coil disposed along the valve body and around the armature.

2. The hydraulic fuel system according to claim 1, where the low pressure side further comprises:

a sump;

a low pressure reservoir connected to the high pressure pump; and a low pressure pump connected to the sump and the low pressure reservoir.

3. The hydraulic fuel system according to claim 1, further comprising at least one fuel injector connected to the at least one high pressure reservoir.

4. The hydraulic fuel system according to claim 3, where the hydraulic fuel system is a hydraulically-activated electronically-controlled unit injection (HEUI) fuel system.

5. The hydraulic fuel system according to claim 1, further comprising an injection pressure regulation (IPR) valve connected to the high pressure pump and the at least one high pressure reservoir.

6. The hydraulic fuel system according to claim 5, where the close-mounted value controls at least one of a hydraulic fluid volume and a hydraulic fluid pressure and the IPR valve controls the hydraulic fluid pressures.

7. The hydraulic fuel system according to claim 6, where the IPR valve provides a trim control of the hydraulic fluid pressure.

8. The hydraulic fuel system according to claim 1, further comprising a control device to supply a current to the valve coil.

9. A pump for a hydraulic fuel system in an internal combustion engine, comprising a drive shaft;

a shaft cylinder radially aligned with the drive shaft, the shaft cylinder forming a shaft cavity;

at least one cylinder disposed adjacent to the shaft cylinder, where the at least one cylinder forms at least one cylinder inlet into the shaft cavity; and a close-mounted valve disposed in the shaft cavity, the close-mounted valve comprising, a valve body forming a valve cavity having at least one valve outlet corresponding to the at least one cylinder inlet, a valve spool with an armature slidably disposed in the valve cavity, a valve spring is disposed between the armature and the valve body to bias the valve spool, and a valve coil is disposed along the valve body and around the armature.

10. The pump according to claim 9, further comprising:

a drive shaft having a swash plate; and a slipper plate disposed between the shaft cylinder and the swash plate.

11. The pump according to claim 10, further comprising a biasing device disposed on the shaft cylinder to bias the slipper plate against the swash plate.

12. The pump according to claim 11, further comprising at least one piston slideably disposed in the at least one cylinder, the at least one piston pivotally mounted to the slipper plate.

13. The pump according to claim 12, where the at least one piston slides in a reciprocating motion in the at least one cylinder, the reciprocating motion to open and close the at least one cylinder inlet.

14. The pump according to claim 9, where the at least one valve outlet is closed when the valve spool is biased by the valve spring; and where the at least one valve outlet is open when a current is applied to the valve coil.

15. The pump according to claim 14, where the valve spool slides in a reciprocating motion in the valve cavity, the reciprocating motion to open and close the at least one valve outlet.

16. The pump according to claim 9, further comprising a microprocessor to supply a current to the valve coil.

17. The pump according to claim 9, where the hydraulic fuel system is a hydraulically-activated electronically-controlled unit injection (HEUI) fuel system.

* * * * *